US007194825B2

(12) United States Patent
Faber et al.

(10) Patent No.: US 7,194,825 B2
(45) Date of Patent: Mar. 27, 2007

(54) SNOWSHOE

(75) Inventors: Guy Faber, Neufchâtel (CA); Richard Faber, Loretteville (CA)

(73) Assignee: Faber & Co. Ltd., Quebec (CA)

( * ) Notice: Subject to any disclaimer, the term of this patent is extended or adjusted under 35 U.S.C. 154(b) by 91 days.

(21) Appl. No.: 11/085,121

(22) Filed: Mar. 22, 2005

(65) Prior Publication Data

US 2006/0213089 A1 Sep. 28, 2006

(51) Int. Cl.
*A43B 5/04* (2006.01)

(52) U.S. Cl. ..... 36/124; 36/125

(58) Field of Classification Search ..... 36/122–125
See application file for complete search history.

(56) References Cited

U.S. PATENT DOCUMENTS

| | | | | |
|---|---|---|---|---|
| 3,299,541 | A | 1/1967 | Snyder | |
| 3,636,643 | A | 1/1972 | Ludquist | |
| 4,041,621 | A | 8/1977 | Anderson | |
| 4,045,889 | A | 9/1977 | Woolworth | |
| 4,085,529 | A | 4/1978 | Merrifield | |
| 4,259,793 | A | 4/1981 | Morgan, Jr. et al. | |
| 4,348,823 | A | 9/1982 | Knapp et al. | |
| 4,720,927 | A | 1/1988 | Abegg | |
| 4,720,928 | A | 1/1988 | Faber et al. | |
| 5,014,450 | A | 5/1991 | McGrath | |
| 5,309,652 | A | 5/1994 | Campbell | |
| 5,469,643 | A | 11/1995 | Forrest | |
| 5,682,688 | A | 11/1997 | Gallay | |
| 5,720,120 | A | 2/1998 | Smith | |
| 5,740,621 | A | 4/1998 | Wing et al. | |
| 5,809,668 | A | 9/1998 | Kiniry et al. | |
| 5,946,829 | A | 9/1999 | Quellais et al. | |
| 6,003,249 | A | 12/1999 | Watson | |
| 6,052,922 | A | 4/2000 | Bleck | |
| 6,163,984 | A | 12/2000 | Faber et al. | |
| 6,226,899 | B1 | 5/2001 | Klebahn et al. | |
| 6,233,849 | B1 | 5/2001 | Gallay et al. | |
| 6,725,576 | B2 | 4/2004 | Emerson et al. | |
| 2003/0101623 | A1* | 6/2003 | Settelmayer | 36/124 |
| 2004/0250453 | A1* | 12/2004 | Settelmayer | 36/122 |

FOREIGN PATENT DOCUMENTS

| | | |
|---|---|---|
| CA | 2291526 | 12/1999 |

* cited by examiner

*Primary Examiner*—Ted Kavanaugh
(74) *Attorney, Agent, or Firm*—Francois Martineau

(57) ABSTRACT

The snowshoe includes an opened U-shaped frame supporting a semi-rigid decking having a toe hole and a harness pivotally attached to the decking near the toe hole. The absence of a rear tail portion on the frame forms a gap that helps prevent the dragging effect of the snowshoe while it trails on the ground during gait. Also, the harness is pivotally attached to the decking by means of a harness attachment that includes an anti-torsion shoulder that will abut on the edge of the decking in the toe hole, to prevent the harness from rotating about an axis that is transversal to the decking.

2 Claims, 5 Drawing Sheets

SNOWSHOE

FIELD OF THE INVENTION

The present invention relates to a snowshoe, and more particularly to a snowshoe with an opened, U-shaped frame and with a flexible harness attachment comprising an anti-torsion device to enhance lateral control of the snowshoe.

BACKGROUND OF THE INVENTION

Known snowshoes include different types of pivotable attachments of the harness to the decking or the frame of the snowshoe, to allow the person's foot to be pivotally attached to the snowshoe. Many known harness attachments allow some undesirable torsion or rotation of the harness about a axis that is transversal to the snowshoe decking, for example about a vertical axis if the snowshoe horizontally rests on the ground. This allows the heel of the person's foot to move laterally on the decking, or more generally this allows the snowshoe to move laterally relative to the foot, which is undesirable. This lateral movement is called a lack of lateral control of the snowshoe.

Furthermore, it is known to provide snowshoes with a closed-loop rigid frame that carries a flexible or semi-flexible decking therein. The flexibility of the decking is often desirable to allow it to adapt to the uneven underlying snow surface. And the rigidity of the frame is also desirable to prevent the snowshoe frame from being deformed. However, a problem associated to the closed-loop frame is that the rear transversal frame portion or tail that links the rear extremities of the two side bars of the frame, will provoke a non-negligible drag as it trails on the ground during gait. Indeed, as known in the art, the snowshoe harness that is attached to the person's foot, is pivoted only at its front portion to the snowshoe itself. Consequently, at each step, as the foot is brought back from a rearward position to a frontward position, the snowshoe front tip is raised spacedly over ground and the snowshoe rear trailing end is dragged on the ground. The dragging effect of the rearmost tail portion of the frame increases the effort required to move the snowshoe forward at each step, in addition to the possibility of it remaining caught in tree branches or other obstacles that protrude over the snow surface. This rear tail portion also undesirably increases the weight of the snowshoe and its production cost. Some snowshoes further include transversal rods that extend at an intermediate portion of the snowshoe between the snowshoe side bars. These transversal rods, which are used to increase the rigidity of the frame, are also undesirable since they contribute to increase the drag, the weight and the production cost of the snowshoe.

SUMMARY OF THE INVENTION

The present invention relates to a snowshoe defining opposite front and rear ends and opposite first and second sides and comprising:

an opened, rigid, U-shaped frame member having first and second elongated parallel side bars respectively located on said snowshoe first and second sides and integrally linked by an arcuate front frame tip portion, said frame member having a gap near said rear end of said snowshoe between said first and second side bars;

a decking that is at least semi-rigid, that extends within said U-shaped frame member and that is attached to said U-shaped frame member, said decking defining a toe hole and a rear edge; and a harness pivotally attached to said decking;

wherein said rear edge of said decking is located at and forms said snowshoe rear end.

The present invention also relates to a snowshoe defining opposite front and rear ends and opposite first and second sides and comprising:

a rigid frame member;

a decking that is at least semi-rigid, that extends within said frame member and that is attached to said frame member, said decking defining opposite upper and lower surfaces and a transverse toe hole having a peripheral edge; and a harness pivotally attached to said decking, said harness comprising a load-bearing toe plate extending partly over said decking upper surface and partly over said toe hole, an attachment member attached to said toe plate for releasably attaching said harness to a person's foot resting on said toe plate, a flexible tongue attached to said decking lower surface and attached to said toe plate through said toe hole, and an anti-torsion shoulder located between said toe plate and said flexible tongue in said toe hole;

wherein said harness is pivotable between a first position in which said toe plate extends substantially parallel to said decking and said anti-torsion shoulder is positioned closely adjacent to said peripheral edge of said toe hole to abut against said peripheral edge of said toe hole if said harness is pivoted about an axis that is generally transversal to said decking; and a second position in which said toe plate is pivoted within said toe hole so as to transversely extend partly through said toe hole.

In one embodiment, said attachment member extends underneath and is attached to said toe plate and defines attachment straps above said toe plate for attaching said harness to a person's foot, with said harness further comprising a claw plate that is attached to said attachment member and that has a toothed portion extending within said toe hole of said decking.

DETAILED DESCRIPTION OF THE EMBODIMENTS

Figure 1:
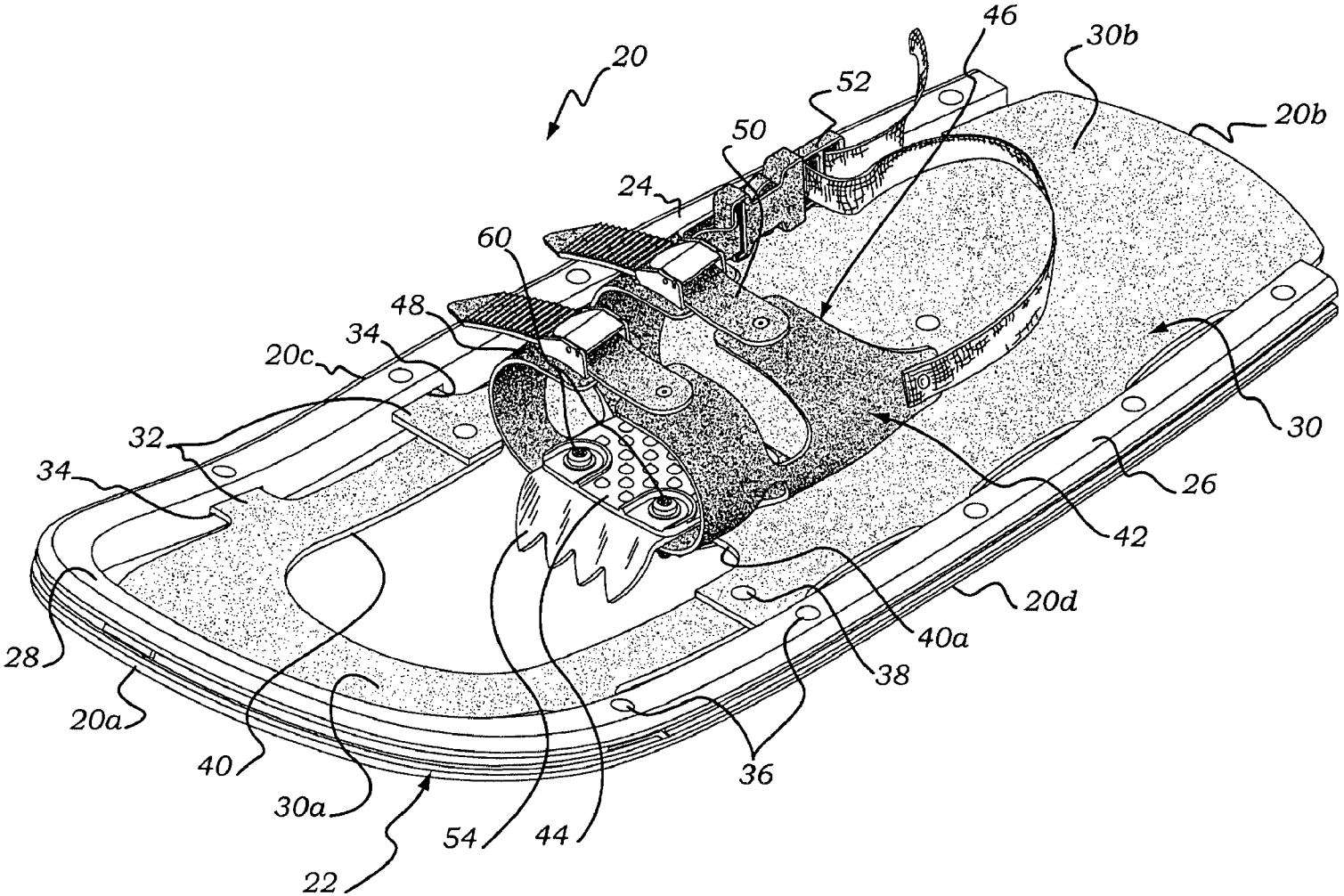
FIGS. 1 and 2 are respectively top and bottom perspective views of the snowshoe according to the present invention.
Figure 2:
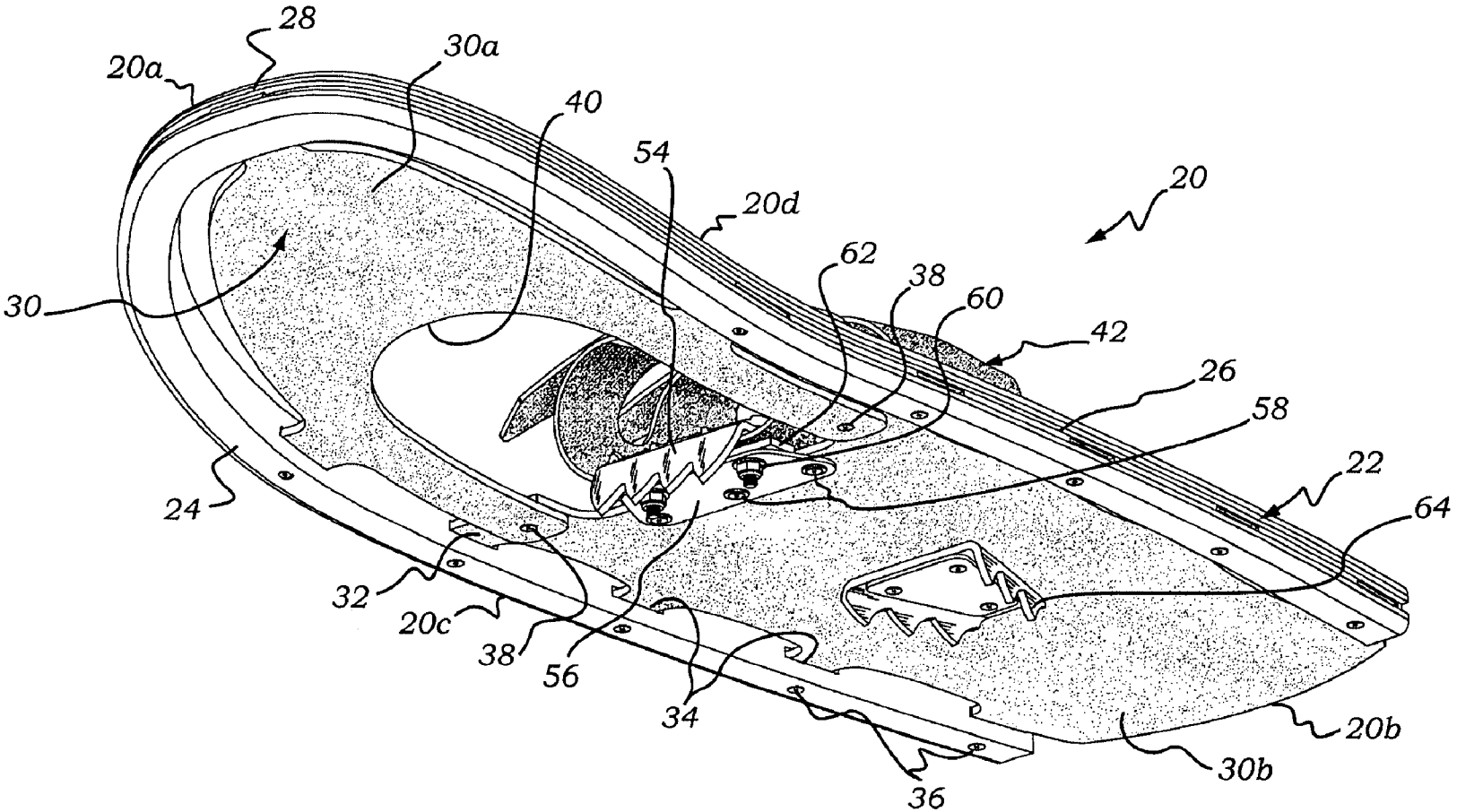
Figure 3:
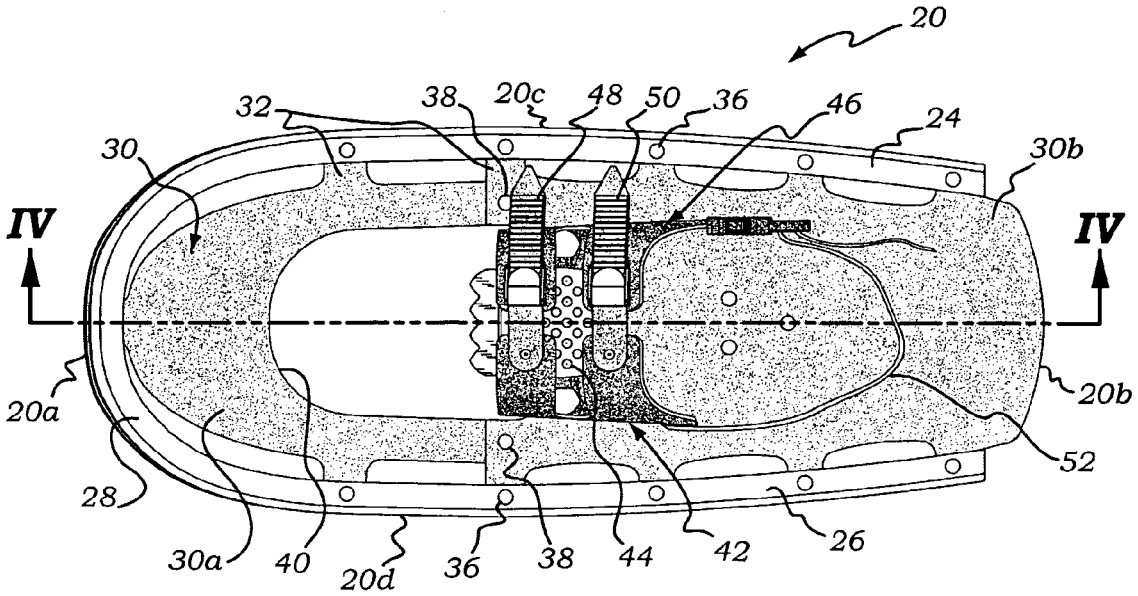
FIG. 3 is a top plan view of the snowshoe of FIGS. 1–2.
Figure 4:
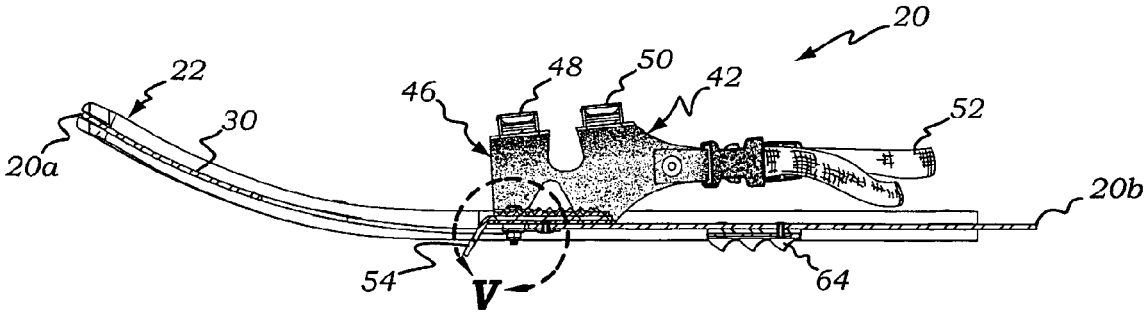
FIG. 4 is a cross-sectional side elevation taken along line IV—IV of FIG. 3.

FIGS. 1–4 show a snowshoe 20 according to the present invention, that defines opposite front and rear ends 20*a*, 20*b* and opposite first and second sides 20*c*, 20*d*. Snowshoe 20 comprises an opened, rigid, U-shaped frame member 22 having first and second elongated parallel side bars 24, 26 respectively located on the snowshoe first and second sides 20*c*, 20*d* and integrally linked by an arcuate and upturned front frame tip portion 28. Frame member 22 thus defines a gap near the rear end 20*b* of snowshoe 20 between the rear extremities of first and second side bars 24, 26, in that there is not rear tail frame portion. Frame member 22 can be made of a single unitary arcuate U-shaped body as shown in the annexed drawings, or alternately from two or more end-to-end interlinked bars.

Snowshoe 20 also comprises a decking 30 that is at least semi-rigid, extending within U-shaped frame member 22 and attached to U-shaped frame member 22. This attachment of decking 30 to frame member 22 is accomplished by providing a number of peripherally spaced decking fingers 32 that engage corresponding apertures 34 made in the inner surface of frame member 22, with bolts 36 extending through frame member 22 and decking fingers 32 to attach them to each other. It is understood that the attachment of decking 30 to frame member 22 could alternately be made according to any other suitable manner which would be obvious to someone skilled in the art.

Decking 30 is made of two coextensive decking portions 30*a*, 30*b* that are attached to each other with bolts 38. However, it is understood that decking 30 could alternately be made of a unitary decking member, as will be obvious to someone skilled in the art of the present invention. Decking 30 also defines opposite upper and lower surfaces.

Decking 30 defines a toe hole 40 near, although spaced from, the front end of snow shoe 20. Near the rear straight edge 40*a* of toe hole 40 is pivotally installed a harness 42 for attaching snow shoe 20 to a person's foot.

Figure 5:
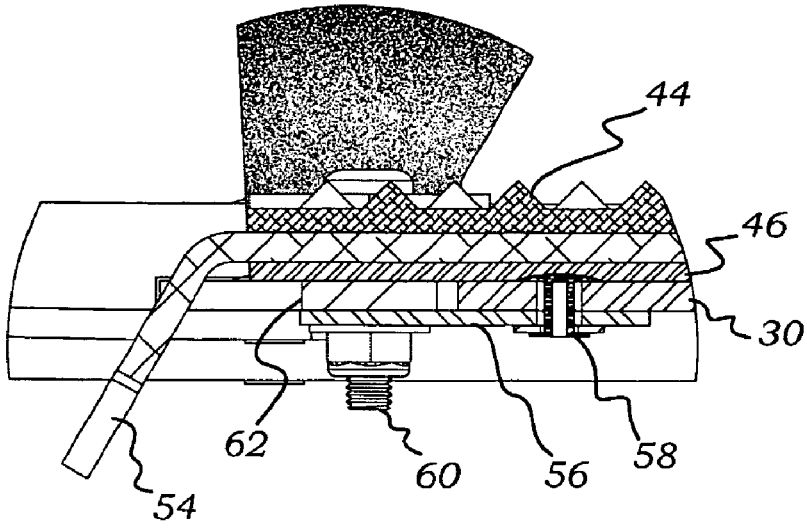
FIG. 5 is an enlarged view of the area circumscribed by line V in FIG. 4, more particularly showing a portion of the harness where it engages the decking of the snowshoe, with the harness being in its first position where it flatly rests on the decking.
Figure 6:
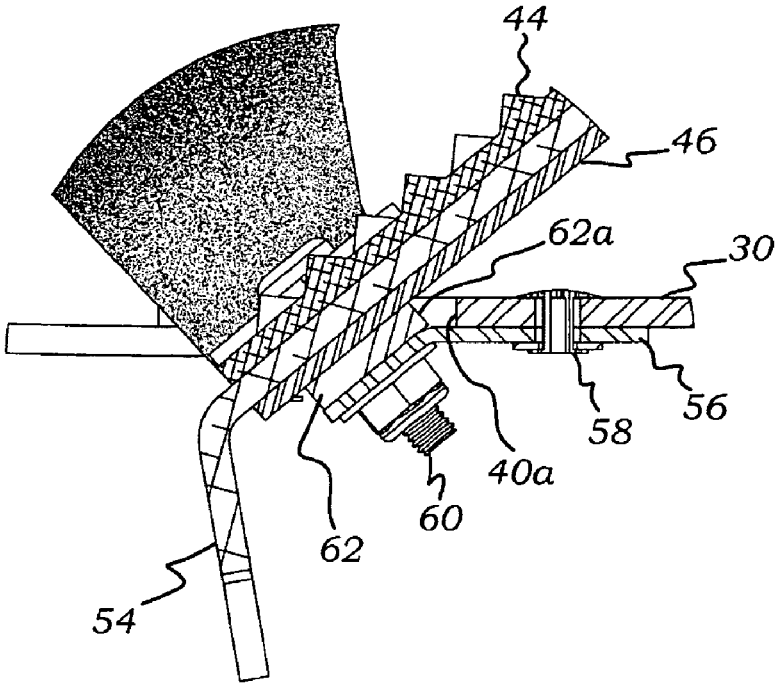
FIG. 6 is similar to FIG. 5, but with the harness being pivoted in its second position where it extends partly through the toe hole of the decking and extends generally transversally to the decking.
Figure 7:
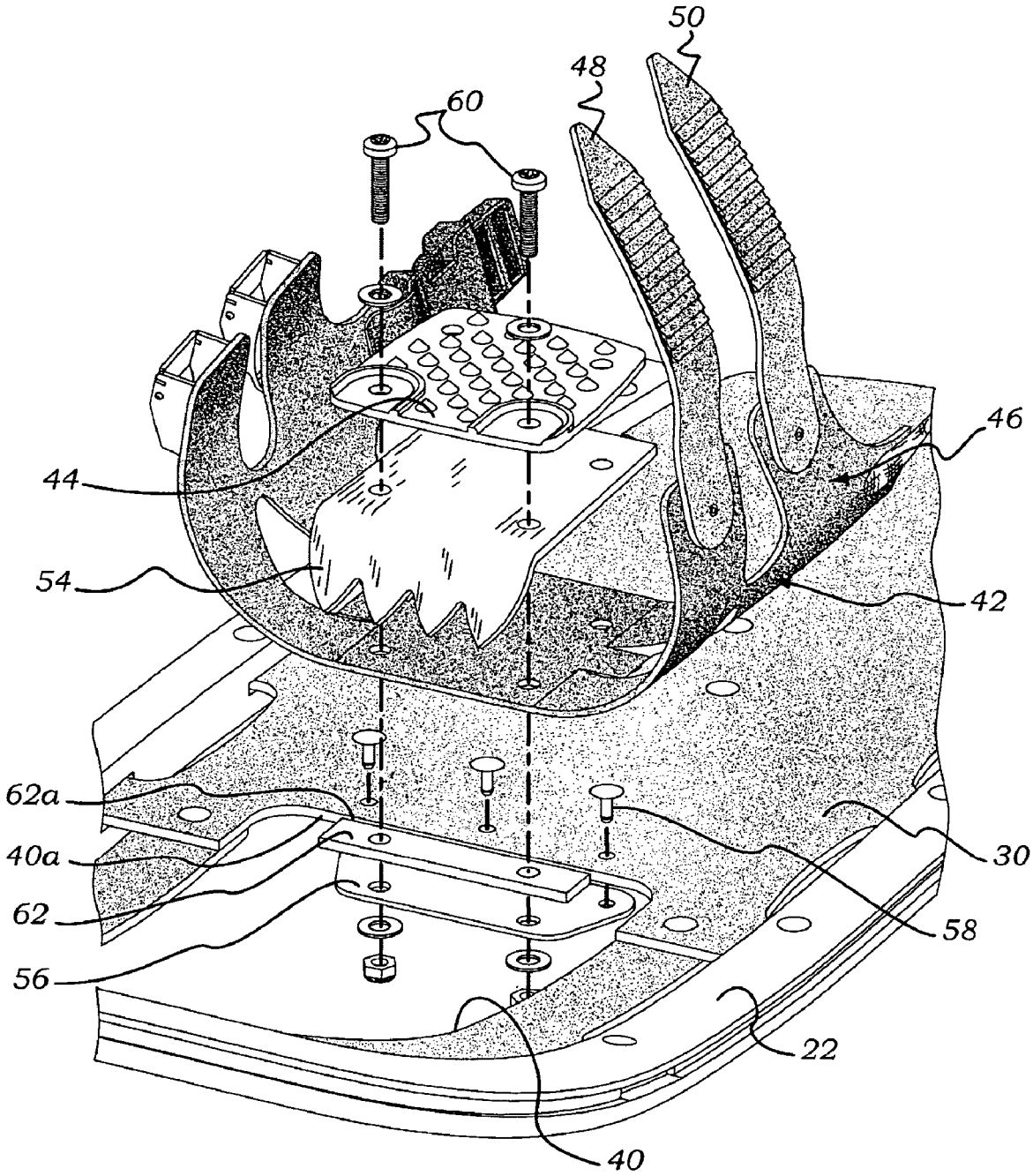
FIG. 7 is a partial enlarged exploded perspective view of the harness where it engages the decking of the snowshoe.

As shown in FIGS. 1–7, harness 42 comprises a load-bearing toe plate 44 on which the snowshoe wearer's front foot portion is destined to rest. Toe plate 44 is mounted to a semi-flexible strap member 46 comprising a pair of adjustable top straps or buckles 48, 50 and a rear adjustable heel strap 52 also equipped with a buckle. Strap member 46 extends underneath toe plate 44 and is caught between toe plate 44 and an optional elbowed toothed claw plate 54 that has a first portion located underneath strap member 46 and a second toothed portion extending downwardly within tow hole 40 to enhance the gripping effect during gait, as known in the art.

A harness attachment member in the form of a rectangular flexible tongue 56 flatly engages and is attached with bolts 58 to the bottom surface of decking 30, near the rear edge 40*a* of toe hole 40. Tongue 56 also protrudes within toe hole 40, and harness 42 is attached to the portion of tongue 56 that protrudes within toe hole 40. More particularly, bolts 60 extend through toe plate 44, strap member 46, claw plate 54, a spacer member 62 and flexible tongue 56 to attach harness 42 to flexible tongue 56 within toe hole 40. As shown more specifically in FIGS. 2 and 5–7, spacer member 62 is an elongated, rigid rectangular plate that has approximately the same thickness as that of decking 30, thus allowing harness to simultaenously rest on decking 30 and spacer member 62 in a horizontal position.

A heel gripping member 64 is bolted to the bottom surface of decking 30 at a position which will approximately correspond to that of a person's heel when this person is wearing snow shoe 20 and his heel rests on the upper surface of decking 30.

In use, a person will wear snow shoe 20 by installing his foot within harness 42. More specifically, the foot will be inserted between the top buckles 48, 50 of harness member 46 and toe plate 40, and the front portion of the person's foot will come to rest upon toe plate 44 with his toes slightly protruding frontwardly thereof. The buckles 48, 50 can be adjusted to the foot. The rear heel strap 52 will extend around the heel of the foot, and will also be adjusted with its buckle to ensure that the foot remains securely held within harness 42.

During gait, the person's foot will move from a first flat position in which the heel of the foot rests on decking 30 of snow shoe 20, to a toe-off position in which the person rests on his toes and the front portion of the foot, with the heel being lifted spacedly above decking 30. Concurrently, harness 42 will be pivoted from a first position shown in FIG. 5 in which toe plate 44 extends substantially parallel to decking 30 when the person's foot is in its flat position; to a second position shown in FIG. 6 in which harness 42 is pivoted partly within toe hole 40 and toe plate 44 becomes transversal to decking 30 when the person's foot is in its toe-off position. This pivotal movement is allowed by the flexibility of flexible tongue 56 that attaches harness 42 to decking 30. Indeed, as the foot is moved from its flat position to its toe-off position, it will force harness 42 between its first and second position, and flexible tongue 56 will yieldingly deform to allow this displacement of harness 42. This deformation will be in the form of tongue 56 folding along an axis which is parallel to the rear edge 40*a* of the toe hole 40 of decking 30. Indeed, with one portion of flexible tongue 56 flatly engaging the bottom surface of semi-rigid decking 30 and with one portion of flexible tongue 56 flatly engaging the rigid spacer member 62, flexible tongue 56 is only allowed to fold along a line that extends parallel to the rear edge of toe hole 40, at the junction of decking 30 and spacer member 62.

The main purpose of spacer member 62 is to help prevent harness 42 from undesirable torsion about an axis that is transversal to decking 30, for example about a vertical axis if snow shoe 20 rests horizontally on the ground. Indeed, in the first position of harness 42 shown in FIG. 5, if harness 42 is rotatably forced about an axis that is transversal to decking 30, spacer member 62 will serve as an anti-rotation or anti-torsion shoulder by abutting against decking 30 to prevent this rotatable torsion. More particularly, it is the rear edge 62*a* of spacer member 62 that will abut against the rear edge 40*a* of toe hole 40 in decking 30 (see FIGS. 6 and 7) that will prevent the torsion of harness 42 relative to decking 30, since spacer member 62 is fixedly attached to toe plate 44. This edgewise abutment thus relies on relatively thin abutment surfaces that have a height equal to the thickness of decking 30. Nonetheless, this is sufficient to accomplish the desired result, i.e. preventing the harness 42 from rotating about an axis that is transversal to decking 30 during use. The anti-torsion function of spacer member 62 will help enhance the lateral control that the snowshoe wearer has over his snowshoe, by preventing undesirable lateral movement of the snowshoe relative to his foot.

It is understood that alternate forms of an abutment shoulder could also be provided, for example a shoulder integrally formed underneath the toe plate, or any other suitable abutment shoulder.

Another advantageous characteristic of the present invention relies in the configuration of the rigid frame 22 that holds decking 30. More particularly, the absence of a rear transverse tail portion between the rear extremities of the frame side bars 20*c*, 20*d*, and of any other crossbar that might be present underneath decking 30 at an intermediate portion thereof, helps prevent an excessive drag during gait. Indeed, in use, the rear end 20*b* of snowshoe 20 will trail on the ground at each step, especially while the corresponding foot is being moved forward spacedly over ground, as known in the art. During this forward movement of the foot, a trailing tail end frame portion located at the rear end 20*b* snowshoe 20 would increase the dragging effect of the snowshoe and reduce its efficiency, and would also be likely to get caught in protruding tree branches and other obstacles. Furthermore, the absence of a rear tail end frame portion reduces the weight of the snowshoe, and its production cost. Thus, the rear edge of decking 30 is located at and forms the snowshoe rear end 20*b*.

It is noted that unless a material with a very high rigidity is used to produce U-shaped frame 22, it is preferable to provide a decking that is at least semi-rigid, since a snowshoe with a flexible decking and an opened, U-shaped frame is likely to lack the rigidity required for preventing any excessive or undesirable deformation of the frame member during use. The expression "at least semi-rigid", concerning the decking, means that the decking may be semi-rigid or rigid. In any event, a highly flexible decking is not an option with an opened, U-shaped frame for the snowshoe would then lack the required rigidity, nor can it be envisioned to use a highly flexible decking in combination with an anti-torsion abutment shoulder according to the present invention since the abutment shoulder could not abut against a flexible decking, the latter then simply bending under the abutment.

We claim:

1. A snowshoe defining opposite front and rear ends and opposite first and second sides and comprising:

a rigid frame member;

a decking that is at least semi-rigid, that extends within said frame member and that is attached to said frame member, said decking defining opposite upper and lower surfaces and a transverse toe hole having a peripheral edge; and a harness pivotally attached to said decking, said harness comprising a load-bearing toe plate extending partly over said deck upper surface and partly over said toe hole, an attachment member attached to said toe plate for releasably attaching said harness to a person's foot resting on said toe plate, a flexible tongue attaching to said decking lower surface and attached to said toe plate through said toe hole, and an anti-torsion shoulder located between said toe plate and said flexible tongue in said toe hole;

wherein said harness is pivotable between a first position in which said toe plate extends substantially parallel to said decking and said anti-torsion shoulder is positioned closely adjacent to said peripheral edge of said toe hole to abut against said peripheral edge of said toe hole if said harness is pivoted about an axis that is generally transversal to said decking; and a second position in which said toe plate is pivoted within said toe hole so as to transversely extend partly through said toe hole.

2. A snowshoe as defined in claim 1, wherein said attachment member extends undercath and is attached to said toe plate and defines attachment straps above said toe plate for attaching said harness to a person's foot, with said harness further comprising a claw plate that is attached to said attachment member and that has a toothed portion extending within said toe hole of said decking.

* * * * *